US005226640A

United States Patent [19]

Puzey

[11] Patent Number: 5,226,640

[45] Date of Patent: Jul. 13, 1993

[54] SHEET FEEDING APPARATUS WITH PRESSURE SENSING VACUUM ASSEMBLY

[76] Inventor: Jon C. Puzey, 6375 W. Surrey, Birmingham, Mich. 48010

[21] Appl. No.: 708,436

[22] Filed: May 31, 1991

[51] Int. Cl.[5] ..... B65H 3/08

[52] U.S. Cl. ..... 271/107; 271/99; 271/108

[58] Field of Search ..... 271/5, 90, 96, 103, 271/107, 108, 99

[56] References Cited

U.S. PATENT DOCUMENTS

| | | | |
|---|---|---|---|
| 3,802,696 | 4/1974 | Shigemori et al. . | |
| 3,921,523 | 11/1975 | Jähme | 271/99 |
| 3,937,458 | 2/1976 | Langen | 271/99 |
| 4,248,417 | 2/1981 | Fujimoto . | |
| 4,327,906 | 5/1982 | Fröhlich et al. | 271/108 |
| 4,391,439 | 7/1983 | Edström | 271/108 |
| 4,580,773 | 4/1986 | Minkle . | |
| 4,589,649 | 5/1986 | Prescher . | |
| 4,653,741 | 3/1987 | Palmer | 271/108 |
| 4,657,236 | 4/1987 | Hirakawa et al. | 271/99 |
| 4,714,242 | 12/1987 | Selak . | |
| 4,730,823 | 3/1988 | Barela et al. | 271/103 |
| 4,759,537 | 7/1988 | Illig et al. . | |
| 4,809,965 | 3/1989 | Vander Meer et al. . | |
| 4,848,764 | 7/1989 | Tajima et al. . | |
| 4,936,566 | 6/1990 | Hiramatsu | 271/108 |
| 4,958,824 | 9/1990 | Willits et al. | 271/103 |
| 4,978,275 | 12/1990 | Reid et al. | 271/108 |
| 5,098,077 | 3/1992 | Russel | 271/99 |

FOREIGN PATENT DOCUMENTS

| | | | |
|---|---|---|---|
| 60843 | 3/1988 | Japan | 271/107 |

*Primary Examiner*—Robert P. Olszewski
*Assistant Examiner*—Steven M. Reiss
*Attorney, Agent, or Firm*—Harness, Dickey & Pierce

[57] ABSTRACT

The sucker assembly is driven into contact with the stack of sheets by a fluid drive air cylinder at relatively slow speed. The stack of sheets is held at a steep incline in the hopper which includes a stock advance drive for keeping the entire stack properly positioned adjacent the sucker pickup point. A pressure sensing transducer measures the vacuum at the suction cupped tip of the sucker and triggers the relatively brisk retraction of a single sheet when proper vacuum is sensed.

9 Claims, 13 Drawing Sheets 56
58
60
66
52
64
53
90
50
53
51
31
92
24
42
38
40
34
31
48
44
46
45

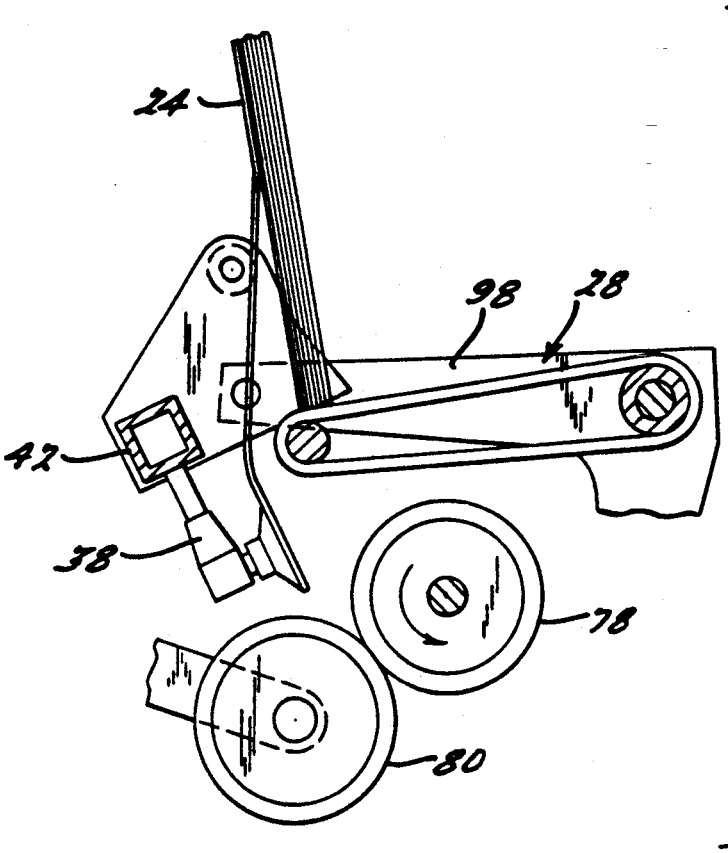
Fig. 13.
Fig. 14.
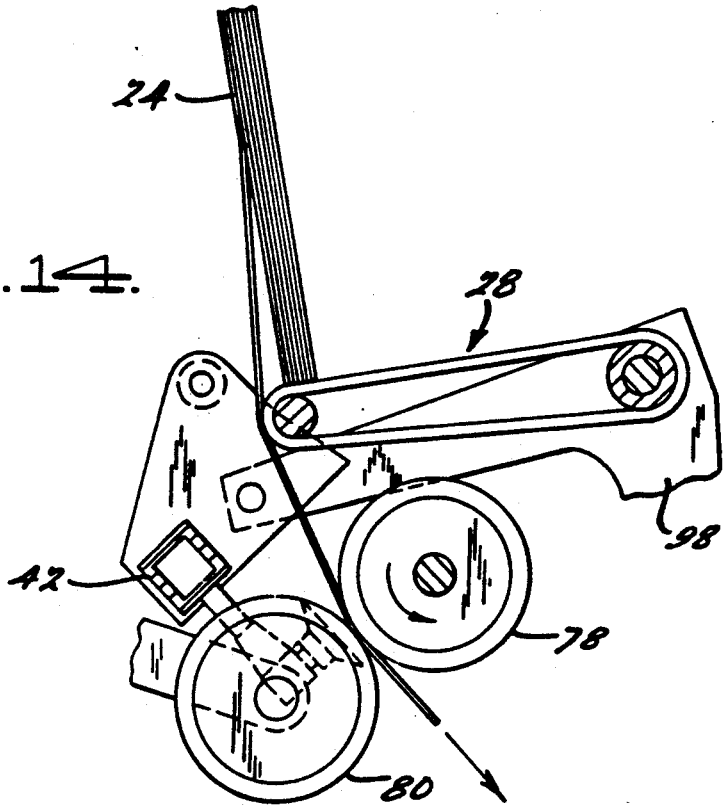

SHEET FEEDING APPARATUS WITH PRESSURE SENSING VACUUM ASSEMBLY

BACKGROUND AND SUMMARY OF THE INVENTION

The present invention relates generally to paper handling and sheet handling equipment. More particularly, the invention relates to a sheet feeding sucker assembly and method of operation which provides a high degree of accuracy and reliability through the use of electrical vacuum sensing control. The sheet feeder has bins with space saving inclined walls which permit a staggered feeding sequence and an analog optical misfeed detection circuit detects when sheets are missing or when multiple sheets stick together.

Sheet feeding mechanisms are used in a wide variety of printing machines, copying machines, collating machines, binding machines and the like. Typically, the sheet feeding mechanism uses vacuum or suction to transport a sheet from one position to another. For example, often a sheet feeding mechanism is provided with a stack of sheets to be fed and a sucker apparatus is used to lift an individual sheet from the stack and move it to a different station for further processing. One or more suction cup devices are used for this purpose. The suction cups are moved into contact with the surface of the sheet to be fed and sufficient suction or vacuum is applied to the suction cup, causing the sheet to stick to it.

When thin or porous sheets are being fed, sometimes the suction will bleed through to the next sheet on the stack, causing two sheets (or more) to be fed instead of only one. This is becoming increasingly problematic as there is increased use of recycled paper, which has a wider range of textures and porosities and which tends to be more difficult to feed accurately. Further, the printing industry is using a wider variety of different paper surfaces and printing inks today. These also make it more difficult to feed accurately, a single sheet at a time.

Prior sheet feeding mechanisms have not adequately addressed the problem of handling different sheet thickness and porosity. Conventional sheet feeding equipment is not sensitive enough, for example, to handle a variety of different sheet thicknesses and porosities without undergoing complicated mechanical recalibration. Conventional equipment, in general, requires a considerable amount of operator adjustment or fine-tuning to work with a given paper stock. A different adjustment and further fine-tuning is often required when the paper stock changes. Some papers, such as some recycled papers, simply have too wide a range of surface texture and porosity to work well with conventional feeders.

The present invention addresses the problem of how to handle different sheet thicknesses and porosities. The invention is readily calibrated or adapted to a wide range of different thickness and porosities; and calibration can be done without a lengthy mechanical retrofitting procedure. The present invention provides a high degree of accuracy and sensitivity to the actual vacuum established when the sheet is being picked up. In contrast with the passive triggering mechanisms of prior art devices, the invention uses highly accurate electrical pressure sensing equipment which allows the invention to lift a single sheet of comparatively porous material before the vacuum level rises to the point where multiple sheets will be adhered.

Accordingly, the invention provides a sheet sucker for a sheet feeding apparatus having a hopper or bin for containing a stack of sheets to be fed and a movable carriage supporting at least one sucker member. A source of suction applies a vacuum to the sucker member and a movement mechanism is provided for selectively moving the carriage in an engaging direction, by which the sucker member is brought into contact with a sheet on the stack of sheets to be fed. The movement mechanism also selectively moves in a retracting direction, by which the sucker member moves away from the stack of sheets to be fed.

Further in accordance with the invention, a control means is coupled to the movement mechanism for selecting the direction of movement. The control means includes electrical or electronic vacuum pressure sensing apparatus which communicates with the sucker member. The control means also includes a readily calibrated electrical or electronic set point comparing device which is coupled to the sensing means for initiating movement in the retracting direction, after the vacuum pressure at the sucker member attains a predetermined level adequate to hold a sheet in contact with the sucker member during movement in the retracting direction.

Aside from the sheet feeding problem, conventional sheet feeders take up a considerable amount of space and are quite expensive. A typical sheet feeder for document assembly will comprise a plurality of individual feed stations, positioned side-by-side and each containing a stack of sheets to be fed. Conventionally, the stacks are horizontally disposed (the sheets are stacked vertically on top of one another), and the sheets are fed onto a conveyor which has fingers to separate the individual assembled documents from one another. In the conventional system a large vacuum source is required, since all feed stations use vacuum to simultaneously extract a sheet from each stack and place it on the conveyor. This creates a considerable peak load on the vacuum system, requiring expensive components.

The present invention offers a considerable improvement over conventional feeders by arranging the stack of sheets on a steep incline, which take much of the weight of the stack off the sheet being fed and minimizes the tendency for two sheets to stick together. By arranging the sheets on an incline, the individual feed stations can be placed closer together so that the resulting feeding apparatus will have a smaller footprint. Also, by allowing the feed stations to be placed closer to one another, it is possible to employ an alternating feed sequence where even stations feed first, followed by odd stations. By sequencing the operation, peak loads on the vacuum system are greatly reduced, thereby reducing the cost of the system.

When two sheets do stick together, as can occur when two sheets are adhered to one another by static electricity, it is important to have a mechanism for sensing this, so that the feeding cycle can be terminated. The problem is one of discriminating between the thickness of a single sheet versus multiple sheets. As noted above, paper stock comes in a wide variety of different thicknesses and surface textures. Conventional sheet feeding equipment has had problems discriminating multiple sheets for misfeed detection purposes, due to the fact that sheet thickness can vary so widely.

The present invention addresses the misfeed problem by providing a highly accurate analog sensing system which employs a mechanically coupled occluding means in the path of an optical beam. The invention is capable of sensing paper thickness with a high degree of accuracy and is capable of being electronically programmed to discriminate a single sheet from a missing sheet or unwanted multiple sheets.

For a more complete understanding of the invention, its objects and advantages, reference may be had to the following specification and to the accompanying drawings.

BRIEF DESCRIPTION OF THE DRAWINGS

FIGS. 10–14 are a sequence of diagrammatic views useful in illustrating the invention in operation;

FIG. 19 is an electronic schematic diagram of the misfeed detection system; and

DESCRIPTION OF THE PREFERRED EMBODIMENT

The Sheet Feed Station

Figure 1:
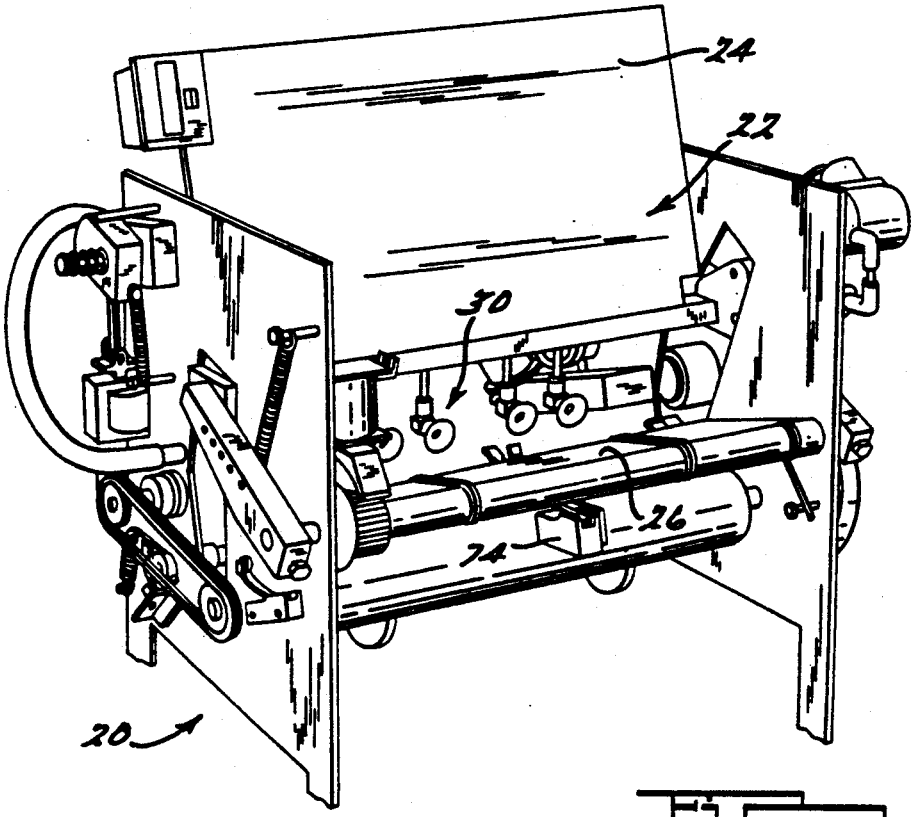
FIG. 1 is a frontal perspective view of the sheet feeding apparatus.

FIG. 1 depicts a sheet feeding apparatus or feed station 20 which implements the presently preferred embodiment of the invention. The illustrated embodiment is merely exemplary of one manner and application for which the invention may be utilized, as the invention is capable of being used in a number of different types of feed stations for a variety of different paper and sheet material handling applications. For purposes of illustration, a single feed station has been shown. In many applications multiple feed stations will be employed to feed the individual pages of a multi-page document. Where this is done, some of the components of the illustrated single feed station, described below, may be shared with the other feed stations.

Figure 2:
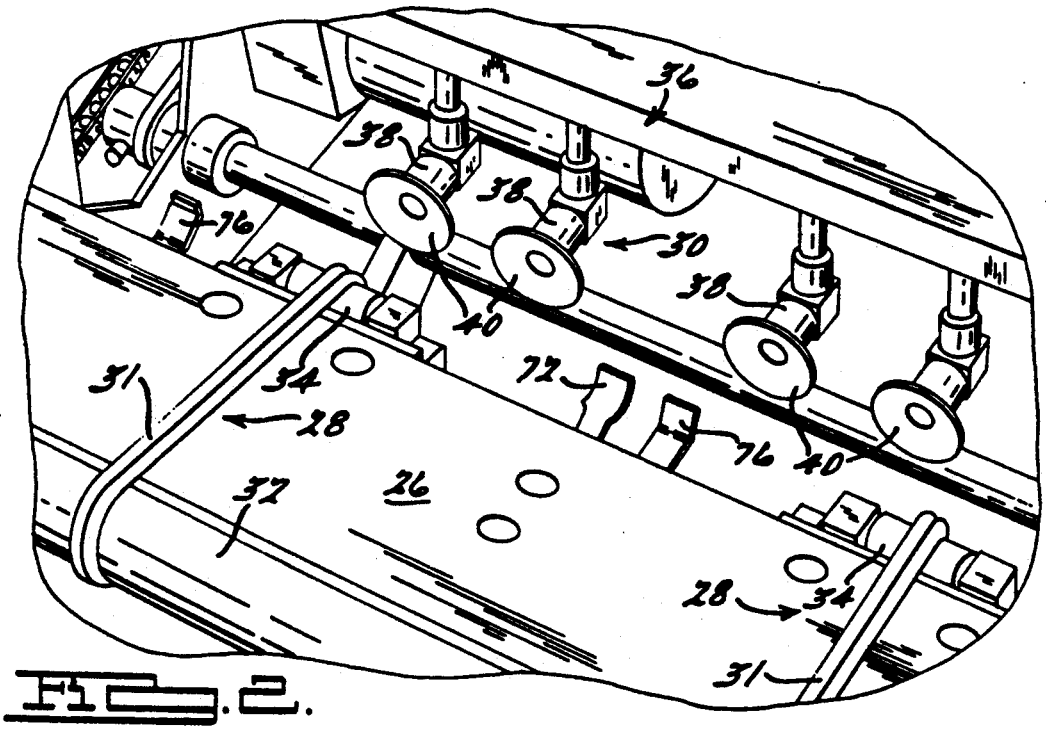
FIG. 2 is a detailed perspective view of the sucker assembly.
Figure 3:
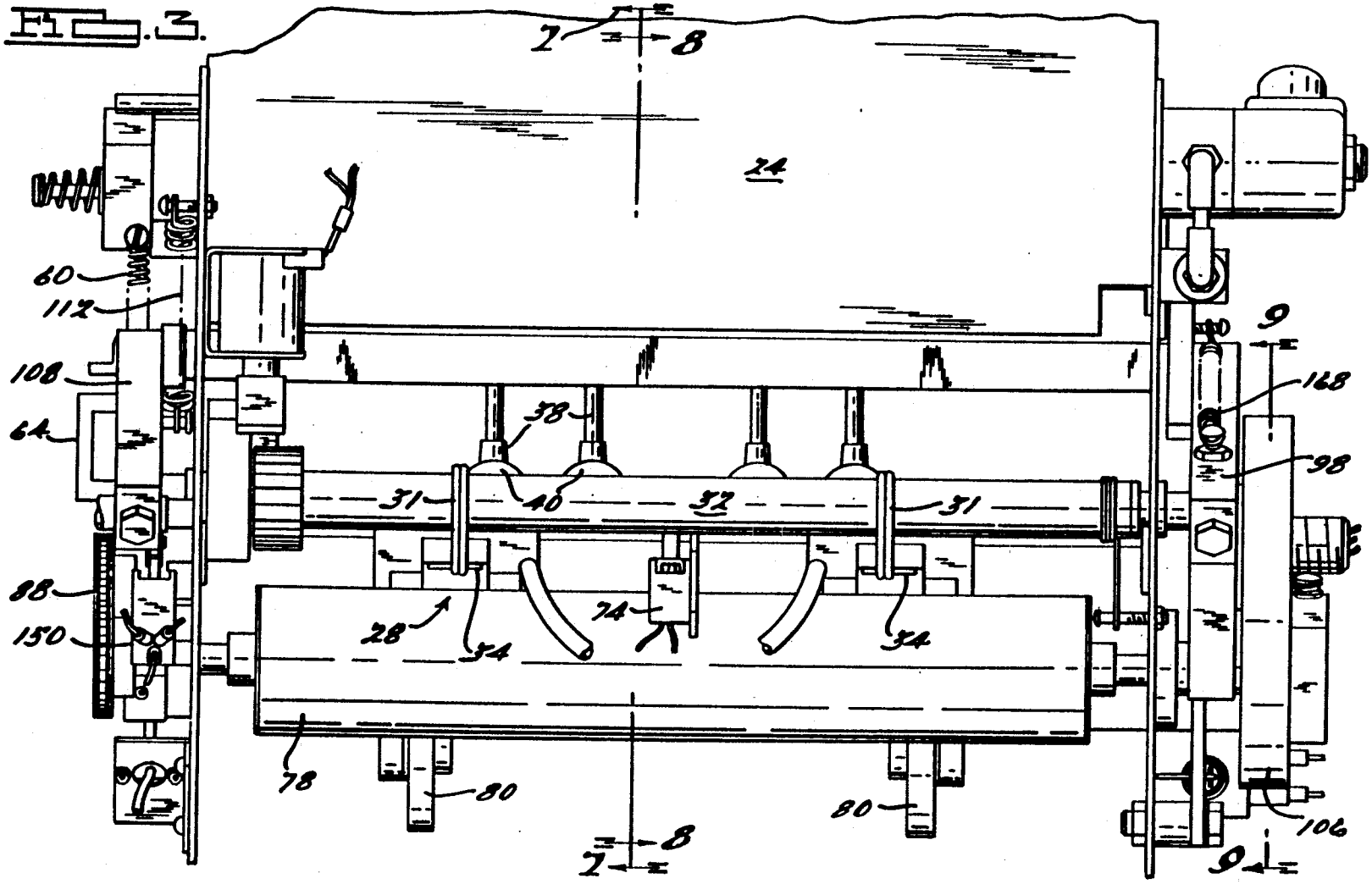
FIG. 3 is a front plan view of the sheet feeding apparatus.

The illustrated sheet feeding apparatus 20 includes a hopper or bin 22 which is adapted for containing a stack of sheets to be fed. Preferably the bin includes an inclined sidewall 24 to allow a stack of sheets to be placed on edge as illustrated in FIGS. 10–14. The bin has a generally horizontal planar bottom 26 (seen in FIGS. 2 and 7) for supporting the stack of sheets at their lowermost edges. The planar bottom is provided with a sheet indexing drive mechanism or stock advance mechanism 28 (seen in FIGS. 1 and 2) for urging or indexing the stack of sheets toward the sucker assembly 30. The stock advance mechanism may be in the form of a plurality of elongated friction drive belts or rings 31 which are rotated or advanced by a sheet indexing drive rod or roller 32. The friction drive rings 31 may be fabricated from rubber O-rings or bands which are stretched between the sheet indexing drive rod and a series of idler rollers 34.

Figure 4:
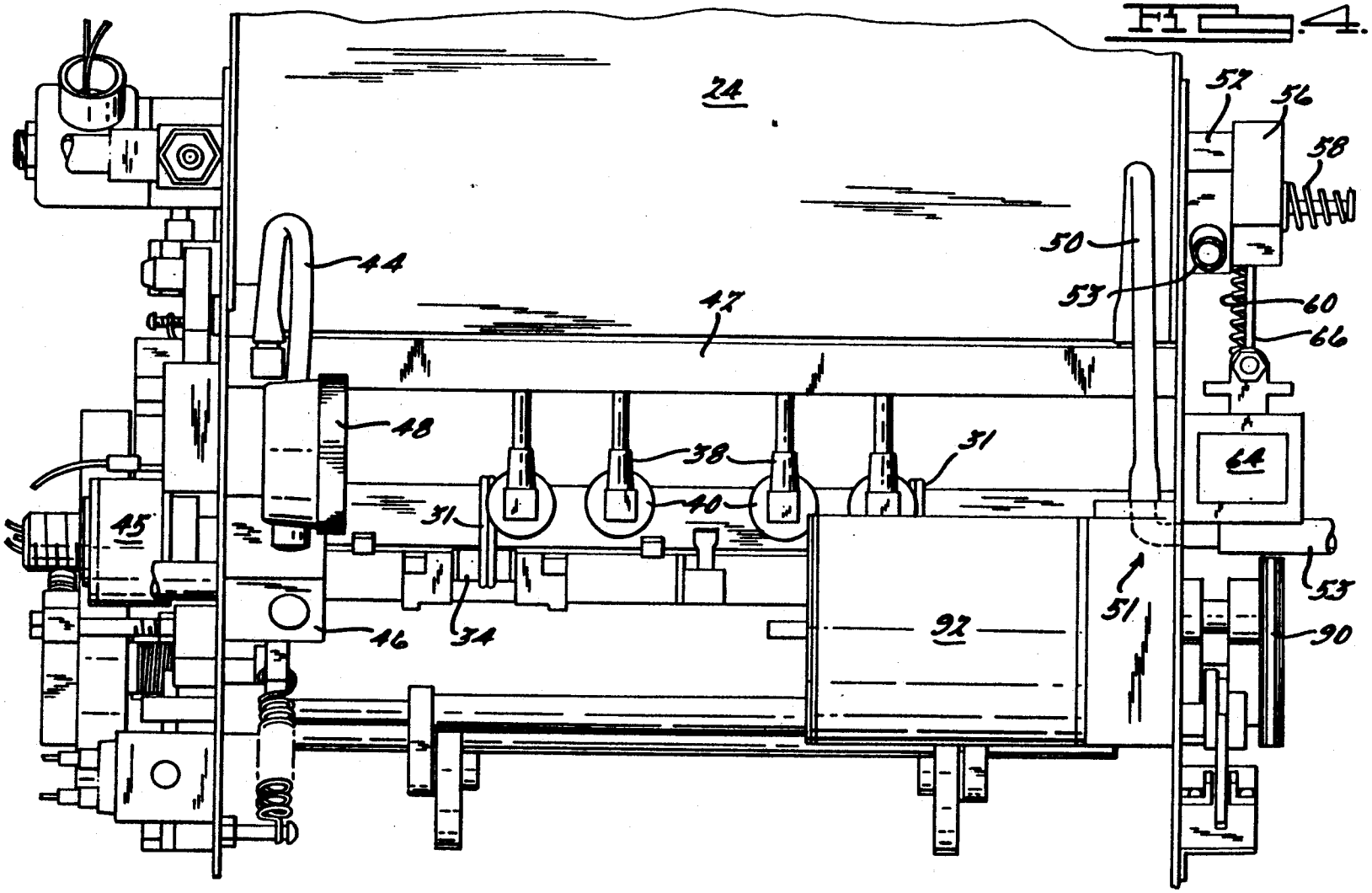
FIG. 4 is a rear plan view of the sheet feeding apparatus.
Figure 5:
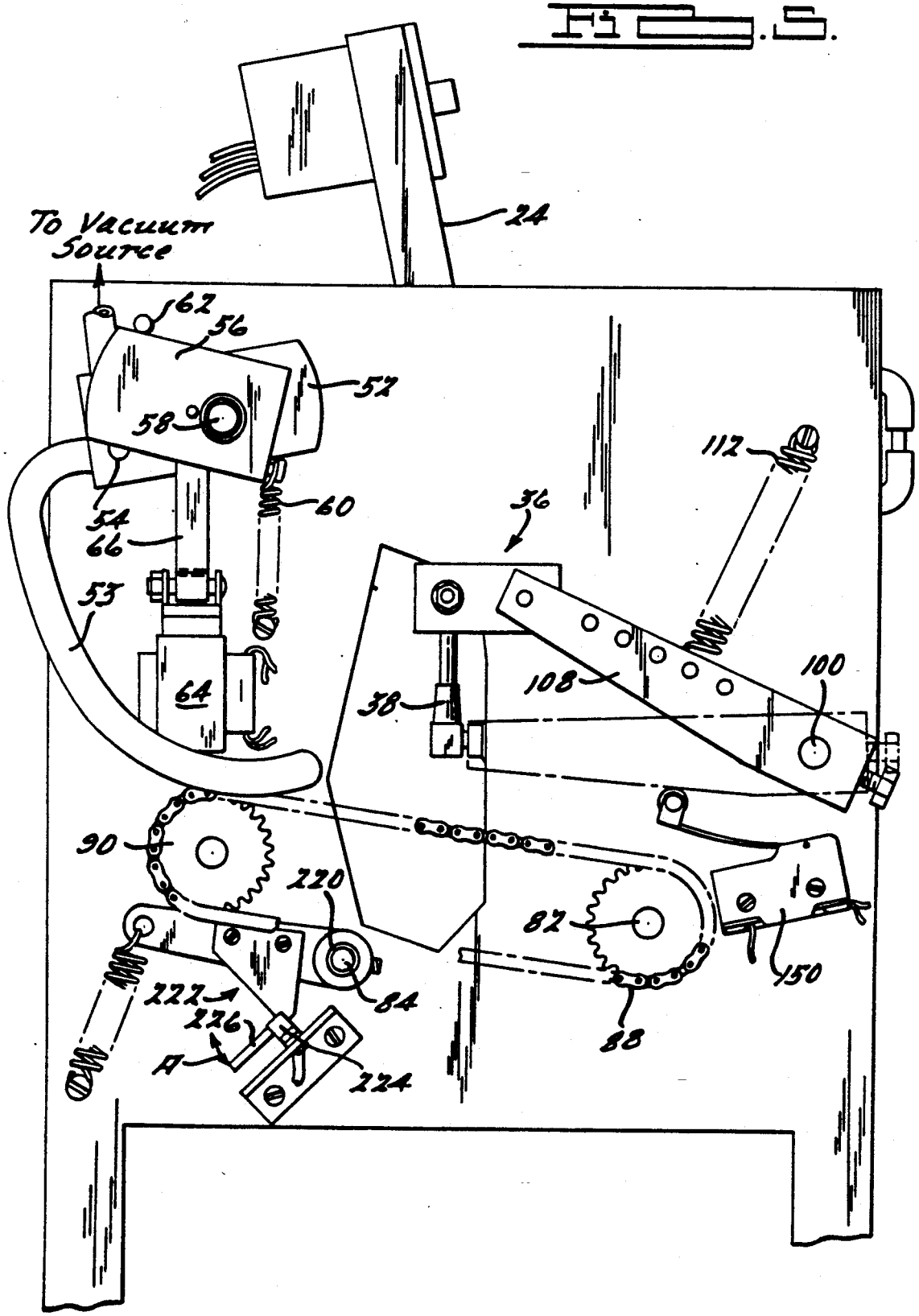
FIG. 5 is a plan view of the left-hand side of the apparatus.

The sucker assembly 30 comprises a movable carriage 36 which supports a plurality of individual sucker members 38. As illustrated, each sucker member includes a suction cupped tip 40 which is made of a pliable plastic or rubber material capable of deforming or flexing sufficiently to conform to the surface of the sheet to be fed. As will be further explained, a vacuum is applied to the sucker members to hold the sheet to be fed in contact with the suction cupped tip. The vacuum is released when it is desired to release the sheet from the suction cupped tip. As seen in the cross-sectional views FIGS. 7 and 8, the movable carriage includes a hollow rectangular sucker bar 42. As seen in FIGS. 4 and 5 the sucker bar defines a vacuum communication manifold which connects each of the sucker members 38 to a source of vacuum through flexible hose 50 and hose 53. The flexible hose 50 connects with hose 53 as at 51. Hose 53 is in turn connected to the vacuum control valve 52. The vacuum control valve 52 is connected to any convenient source of vacuum as shown in FIG. 5.

To release the vacuum when it is desired to release the sheet, the vacuum control valve has an orifice 54 for venting to atmosphere when uncovered as shown in FIG. 5. When vented to atmosphere the sucker bar 42 and each of the associated sucker members 38 are vented to atmospheric pressure. This relieves suction to allow a sheet held in contact with the sucker members to be released. As illustrated in FIG. 5 the vacuum control valve has a movable cover 56 which pivots about spring loaded post 58. A bias spring 60 pivots the cover to the open, orifice venting position at which the side of the cover rests against stop 62. An electrically operated solenoid 64, acting through linkage 66, is energized to rotate cover 56 to the orifice sealing, closed position when it is desired to apply vacuum to the sucker members.

Figure 6:
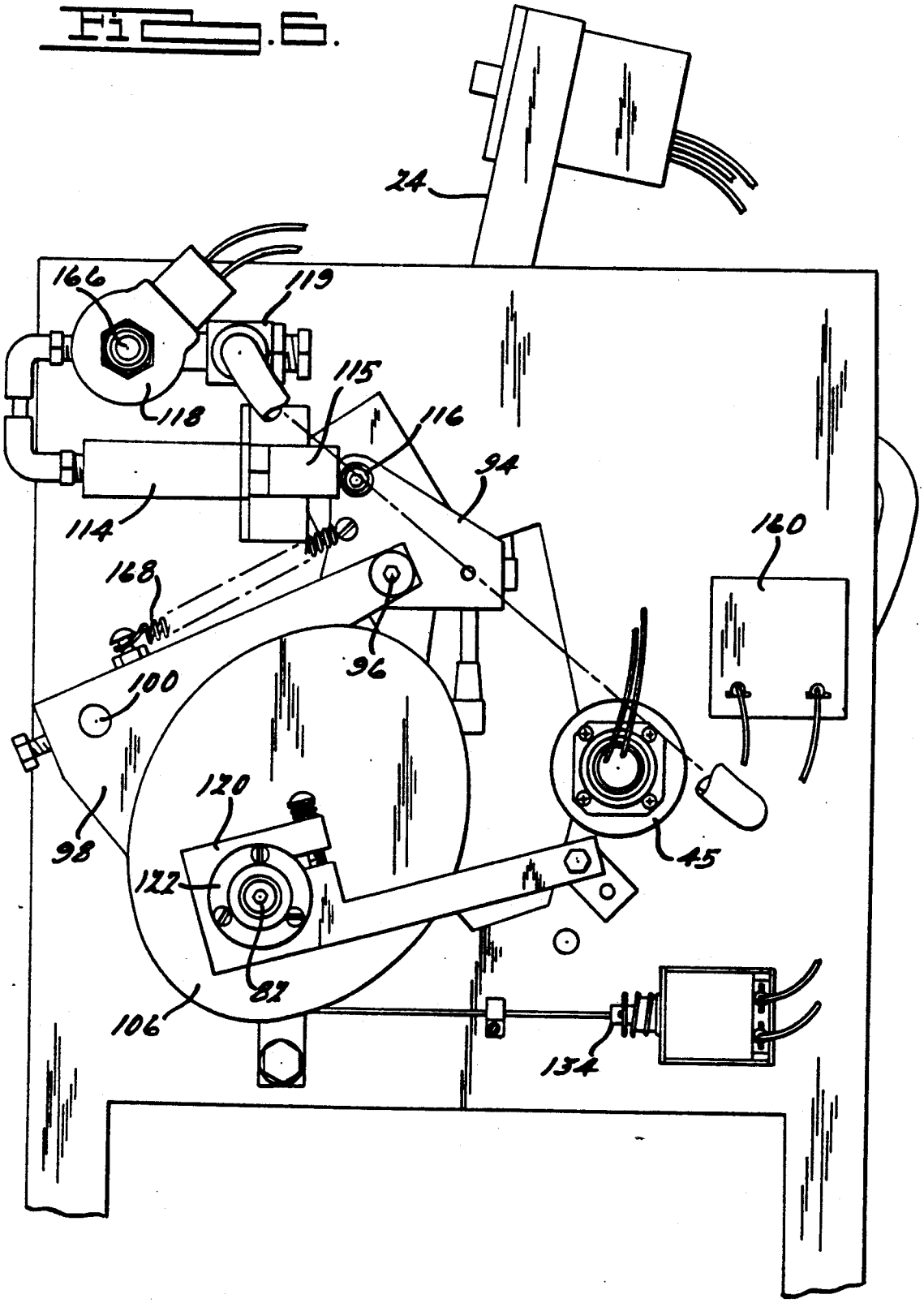
FIG. 6 is a plan view of the right-hand side of the apparatus.
Figure 8:
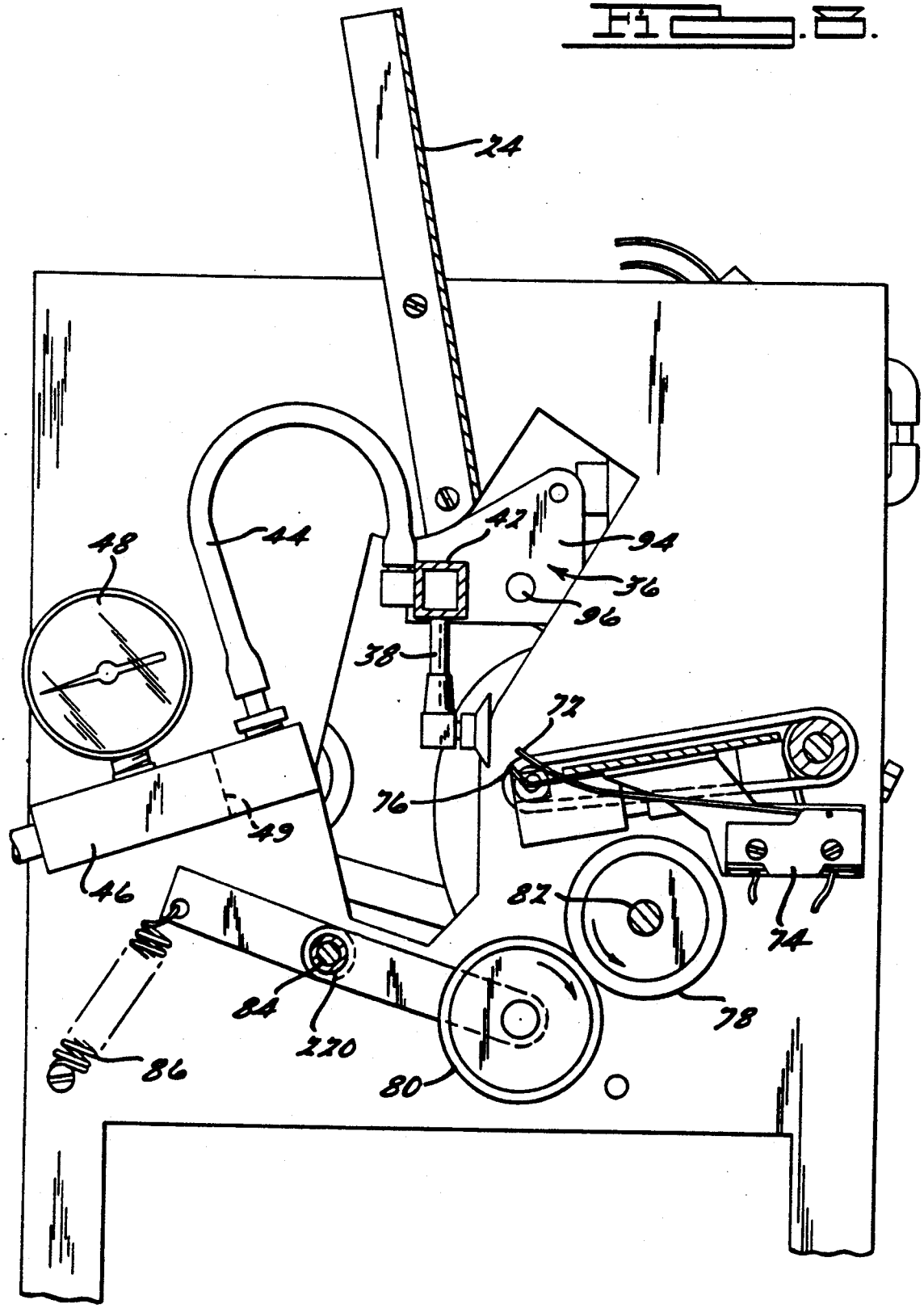
FIG. 8 is a vertical cross-sectional view taken substantially along the line 8—8 of FIG. 3.

The sucker bar 42 is also connected, as shown in FIG. 4, to the vacuum sensing device 45 through flexible hose 44. The vacuum sensing device is also seen in FIG. 6. Although the connection between flexible hose 44 and the vacuum sensing device may be accomplished by a variety of different means, in the presently preferred embodiment the flexible hose is connected to the vacuum sensing device through a portion of the regulated pressure supply system 46 (as seen in FIG. 8). The regulated pressure supply system is isolated from the portion which defines the connection between hose 44 and vacuum sensing transducer device 45 by an internal wall 49, shown in dashed lines in FIG. 8. The regulated pressure supply system 46 is used to deliver regulated operating pressure for a fluid drive mechanism, discussed below. As shown, the regulated pressure supply system includes a pressure gage 48.

In a multiple feed station embodiment, the suction supply systems of individual feed stations may share a common vacuum control valve and vacuum source. The suction supply system for each station incorporates a restriction in the vacuum air flow path, such as at 51, which isolates the local or individual feed station vacuum manifold from the main vacuum manifold or plenum of the shared vacuum source. This allows for a drop in vacuum (pressure increase) at the sucker bar, due to air flow, to occur locally while maintaining a high vacuum level (low pressure) in the main vacuum plenum. The increased local pressure is monitored by the vacuum sensing device 45 used to electrically or electronically sense when the movable carriage is to change directions. The details of this pressure sensing are discussed more fully below.

Figure 7:
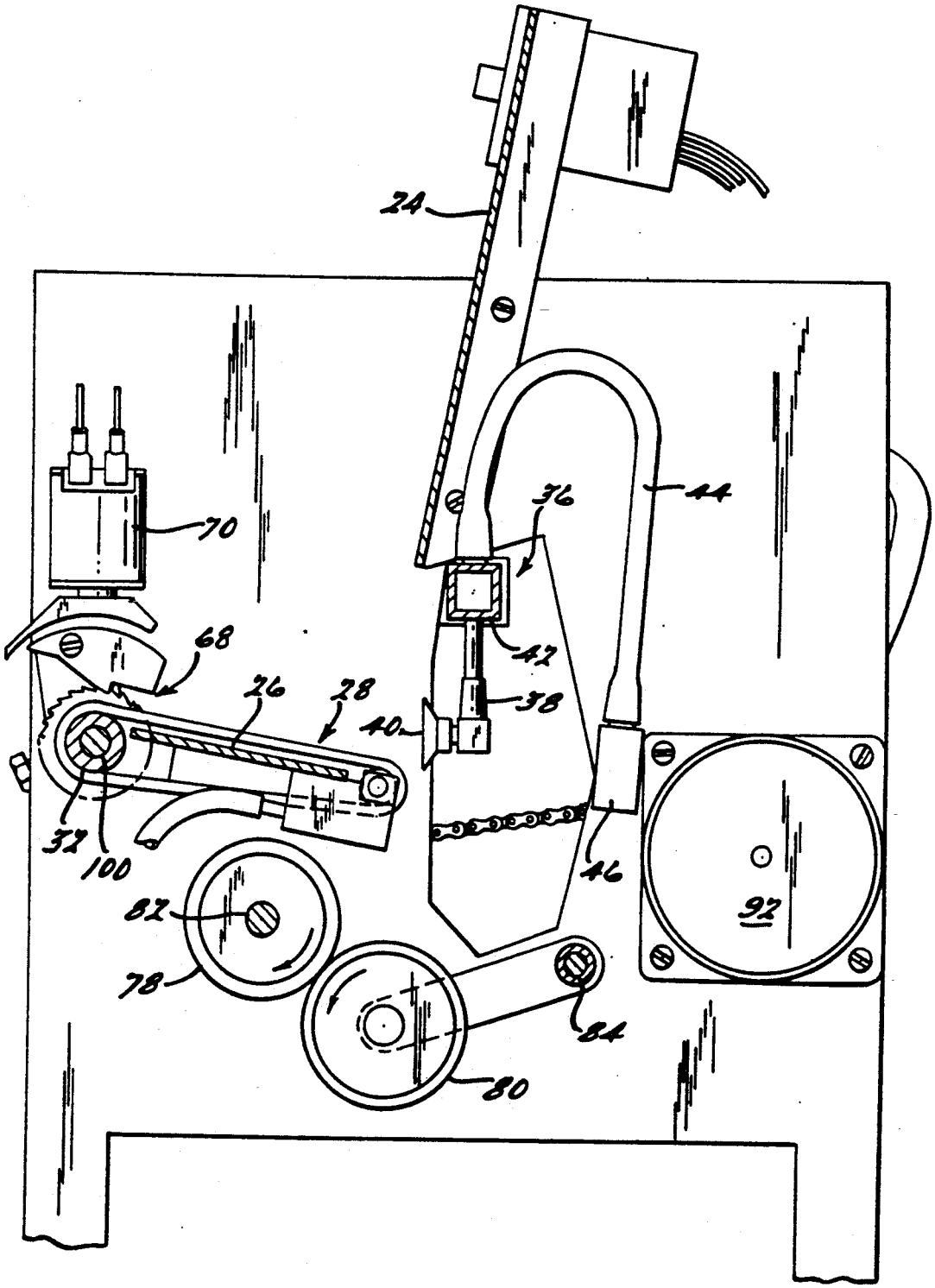
FIG. 7 is a vertical cross-sectional view taken substantially along the line 7—7 of FIG. 3.

Referring to FIGS. 7 and 8, the stock advance mechanism is shown in greater detail. Sheet indexing drive rod or roller 32 cooperates with a ratchet and pawl assembly 68 which indexes to cause the friction drive rings of the stock advance mechanism 28 to move sheets toward the sucker members as drive rod 32 rotates in a clockwise direction. The pawl is attached to the movable carriage which provides a rocking motion. Solenoid 70, when energized, allows engagement of the ratchet and pawl assembly and when de-energized prevents engagement. A sheet edge sensor seen in FIG. 8, and also in FIG. 2, controls when the ratchet and pawl mechanism is switched on and off to effect sheet indexing. Sheet edge sensor 72 is in the form of an elongated arcuate spring member which activates microswitch 74 when not depressed. Sheets are indexed forward by the stock advance mechanism until the edge sensor is tripped. If desired, a plurality of edge alignment guides 76 may be provided to prevent the sheets from being indexed past the desired feed point.

With continued reference to FIGS. 7 and 8, an elongated transfer roller 78 and a plurality of pinch rollers 80 are positioned, as shown, beneath the stock advance mechanism. These rollers are positioned to receive an individual sheet after it is removed from the stack and fed downwardly, as will be shown in greater detail in connection with FIGS. 10–14. The transfer roller 78 is journaled for rotation about a fixed axis on axle 82, whereas the pinch rollers 80 are journaled on axles 84 for articulated movement. A bias spring 86 (FIG. 8) forces the pinch rollers into contact with the transfer roller 78. The rollers cooperate to move in the direction of the arrows shown in FIGS. 7 and 8 so that a sheet fed from the stack will be conveyed through the rollers in a generally downward direction. The rollers also act as calipers for measuring sheet thickness—used in the misfeed detection system. Axle 82 is driven by a sprocket and chain drive assembly 88, which is seen in FIG. 5. The sprocket and chain drive assembly is in turn driven through sprocket 90 by drive motor 92. Drive motor 92 is seen in FIGS. 4 and 7. The drive motor 92 may be a single speed gear motor or preferably a variable speed direct current motor of suitable horsepower to drive the transfer roller of each feed station as well as the main conveyor of the overall sheet feeding apparatus and any sequencing devices, such as the vacuum control valve 52.

The movable carriage 36 is responsible for moving the suckers through a series of motions designed to extract a sheet from the stack and feed it through the transfer and pinch rollers. The movable carriage is designed to swing or articulate between the bin and rollers 78 and 80 (an articulated trajectory). The movable carriage is also designed to move the sucker bar and sucker members in a sheet engaging direction, by which the sucker members are brought into contact with a sheet on the stack, and in a retracting direction, by which the sucker members are moved away from the stack with a sheet adhered to the sucker members. In the presently preferred embodiment a fluid drive mechanism is used to effect movement in the sheet engaging direction and a spring is used to effect movement in the retracting direction. The articulated swinging movement and the sheet engaging/retracting movement occur asynchronously. That is, articulated movement is tied to or in synchronism with rotation of the rollers 78 and 80, where as the sheet engaging/retracting movement is tied to proper measured vacuum being developed at the suction cupped tip.

Figure 9:
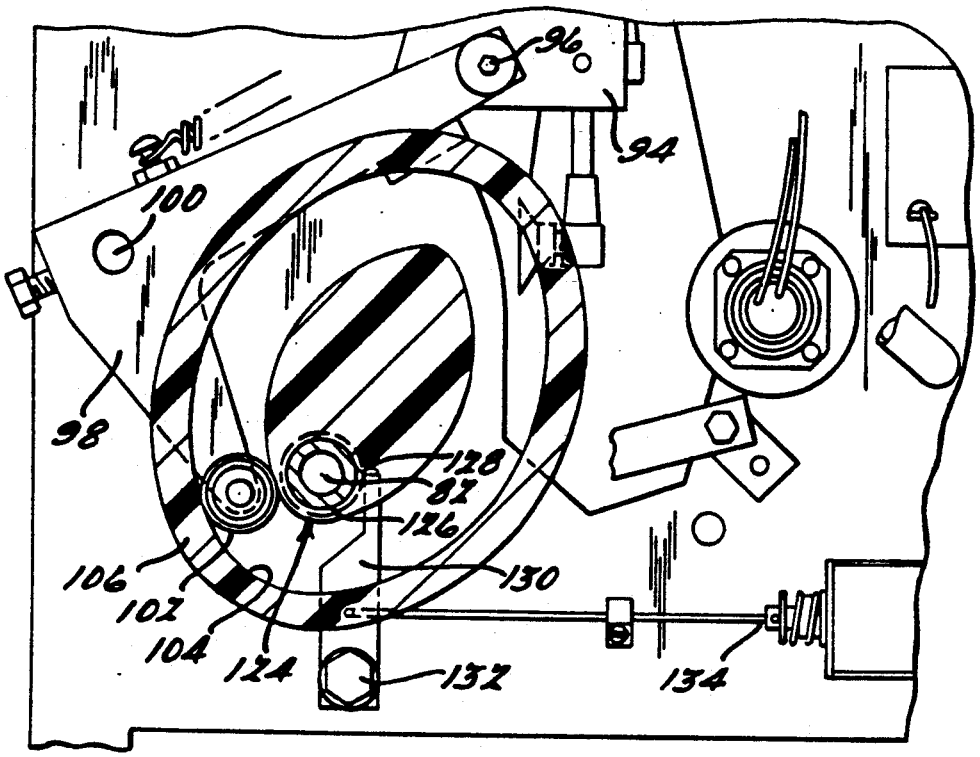
FIG. 9 is a vertical cross-sectional view taken substantially along the line 9—9 of FIG. 3 through the cam.

To effect articulated swinging movement, the movable carriage 36 includes a carriage plate 94, seen in FIGS. 6 and 8. The plate is secured to the sucker bar 42 and pivots about pin 96. Pin 96 is in turn carried by bracket 98 (FIG. 6), which is in turn journaled for rotation about rotating cross shaft 100. As seen in FIG. 9, bracket 98 is generally L-shaped and includes a cam follower portion 102. The cam follower 102 rides within a raceway 104 formed in cam member 106. As seen in FIG. 5, the movable carriage 36 is connected at its opposite end to an arm 108, which is rigidly fixed for articulation with cross shaft 100. Arm 108 is biased in an upward direction by tension spring 112. The entire movable carriage 36 is thus rotatable about the cross shaft 100 as the cam 102 follows raceway 104. Cross shaft 100 provides the rocking motion of the ratchet and pawl as shown in FIG. 7.

In the presently preferred embodiment, the sucker bar is designed to execute one sheet feeding cycle for every two rotations of the transfer roller 78. This relationship is dictated by the diameter of the transfer roller and the length of the sheet to be fed. Although various means can be used to accomplish this, I illustrate a clutch drive mechanism. The clutch drive mechanism has the advantage of allowing movement of the movable carriage to be somewhat independent of the movement of the transfer roller. Directly geared drive mechanisms can be used as an alternative to clutch drive mechanisms.

As seen in FIGS. 6 and 9, cam 106 is coupled via the clutch assembly 124 to the fixed axis axle 82, which is in turn driven by the sprocket and chain drive 88. The cam member 106 is journaled for rotation about the axis of axle 82 and may be held in axial alignment with the axle by any convenient means. As seen in FIG. 9, the clutch assembly 124 employs a clutch spring 126 having an outwardly extending tang or hook 128 which engages latch 130 in order to prevent multiple rotations of the cam member. The clutch spring is affixed at one end to the cam member and fits tightly around axle 82 in its normally wound state. Thus in the normally wound state the cam member will rotate with axle 82. When hook 128 engages latch 130, the clutch spring is unwound slightly to allow axle 82 to slip. This prevents further rotation of the cam member. The latch 130 is pivoted about bolt 132. A solenoid actuated retractor 134 is coupled to the latch and, when activated, pulls the latch in a generally clockwise direction to allow the latch and tang to disengage one another, thereby permitting another rotational cycle of the cam member 106. The presently preferred embodiment uses a friction brake 120 which wraps around hub 122 that rotates with cam member 106 to stop the cam rotation at the end of a cycle.

To effect sheet engaging and retracting movement, the fluid drive mechanism 114 (FIG. 6), comprising an air cylinder and piston, pushes against post 116 on the carriage plate 94. The fluid drive mechanism or air cylinder is supplied with pressurized air from regulated pressure source 46 (FIG. 8) controlled by a solenoid actuated air valve 118 and restricted orifice 119 When supplied with pressure, block 115 at the end of the piston rod pushes against post 116 to extend at a controlled relatively slow velocity. Movement of the fluid drive mechanism to its extended position causes rotation of the carriage plate about pin 96. This in turn rotates the sucker members for movement in an engaging direction by which the sucker members are brought into contact with the sheet to be fed.

Sheet Feed Station Operation

Figure 15:
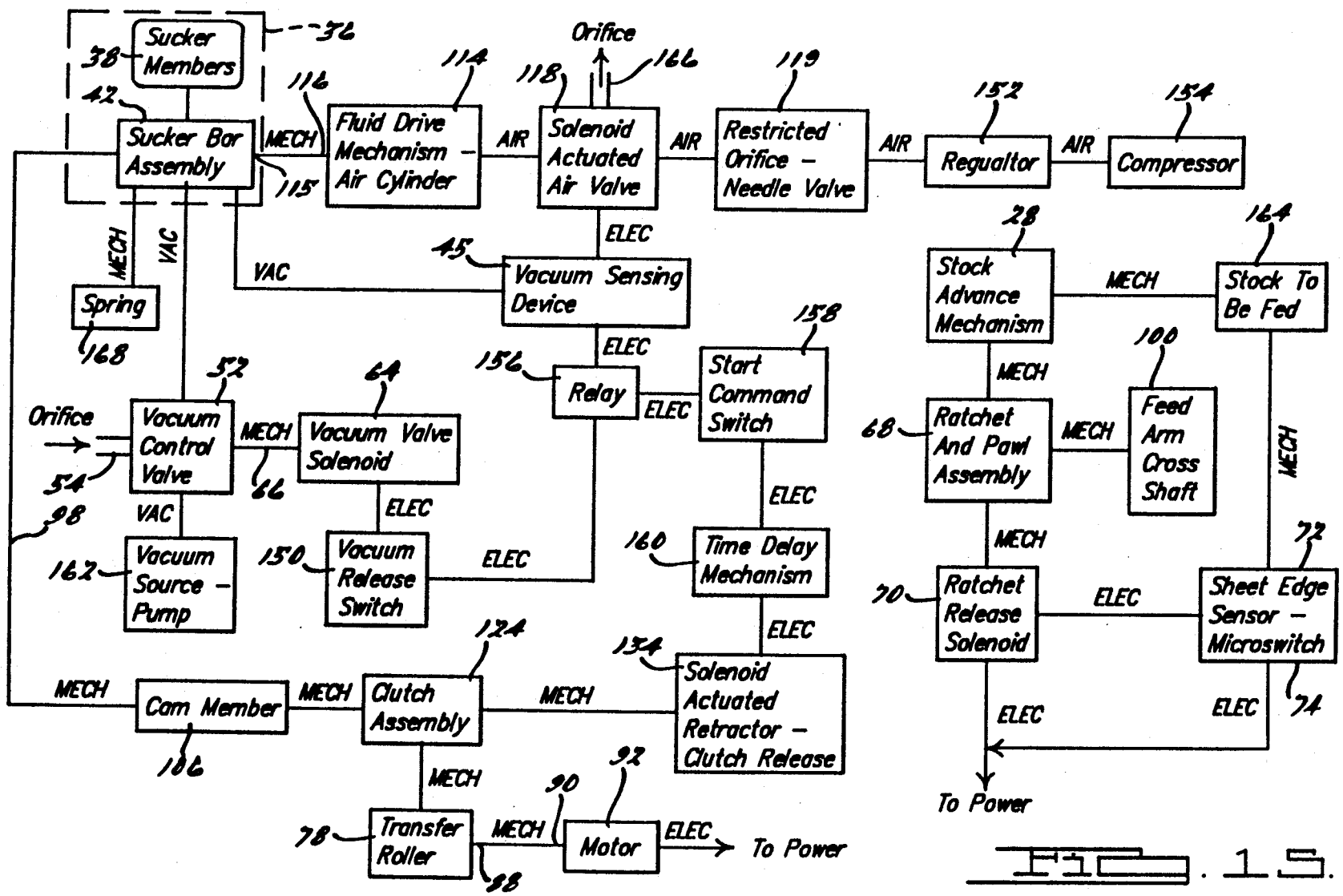
FIG. 15 is a system schematic block diagram.

Referring now to FIG. 15, the major components of the presently preferred embodiment are shown in block diagram form. Where applicable, like components have been given like reference numerals. In FIG. 15, where applicable, the interconnection between components has been designated as mechanical, vacuum, air, electric and so forth, to indicate the manner in which components are interconnected. Reference will also be had to FIGS. 10–14 which show the sequence of operation of the movable carriage, stock advance and sucker mechanisms.

The operational sequence begins with activation of the start command switch 158 (FIG. 15). The start command switch activates relay 156, which in turn activates the solenoid activated air valve 118 (FIG. 6). Relay 156 latches through the vacuum release switch 150 (FIG. 5) and is thus held in the latched state until the vacuum release switch 150 is tripped. The vacuum release switch 150 is tripped when arm 108 reaches the downward position at the end of its downward motion. The air solenoid valve 118, when activated, supplies air to the air cylinder 114 (FIG. 6). As previously described, the air solenoid valve receives pressurized air from restricted orifice 119, which is supplied via regulator 152. A suitable source of pressurized air such as compressor 154 may be used to supply air to the regulator.

Air cylinder 114, when activated, advances the movable carriage toward the stock of sheets to be fed. When the sucker member 38 makes contact with a sheet the vacuum begins to rise and this condition is sensed by the pressure sensor 45. The pressure sensor is set to trigger at a predetermined set point at which time the air solenoid valve 118 is de-energized and thereby vents the air cylinder 114 to atmosphere through orifice 166. Upon venting of air cylinder 114 the spring 168 (seen also in FIG. 6) causes the sucker member to be quickly pulled away from the stock of sheets in the bin.

Figure 10:
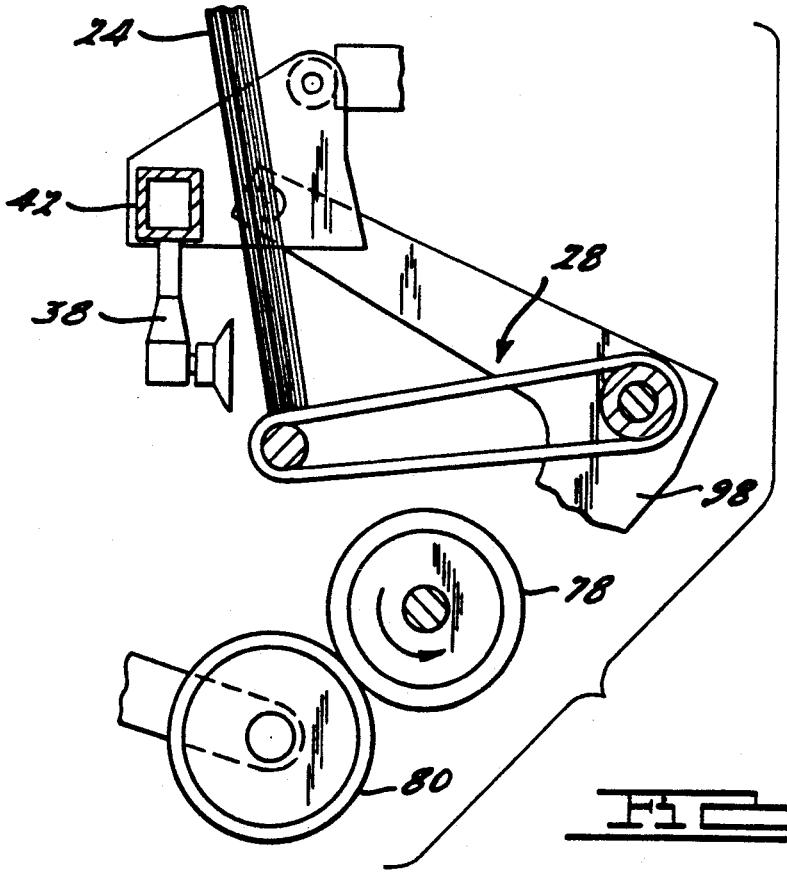
Figure 11:
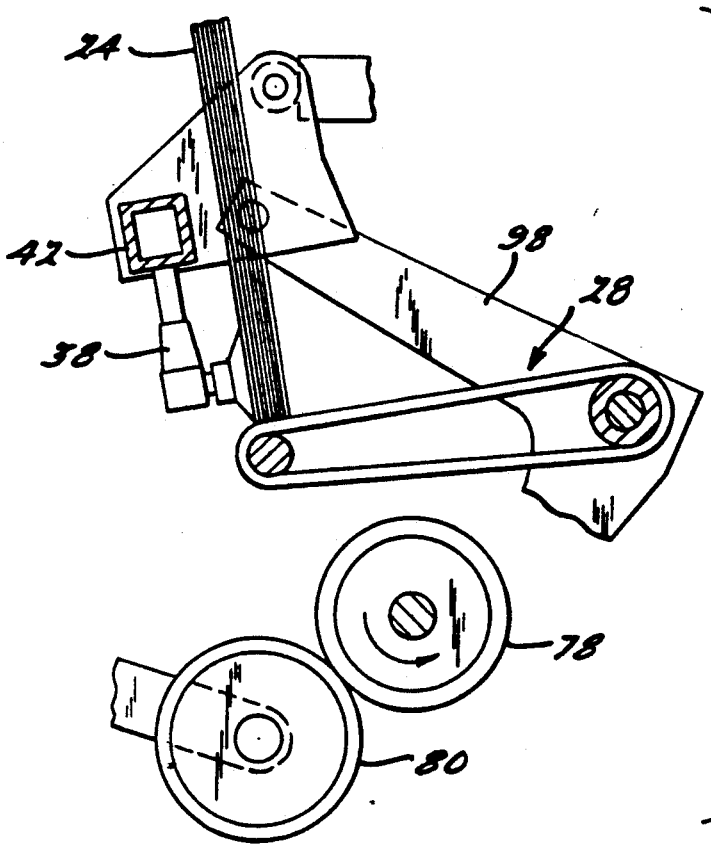
Figure 12:
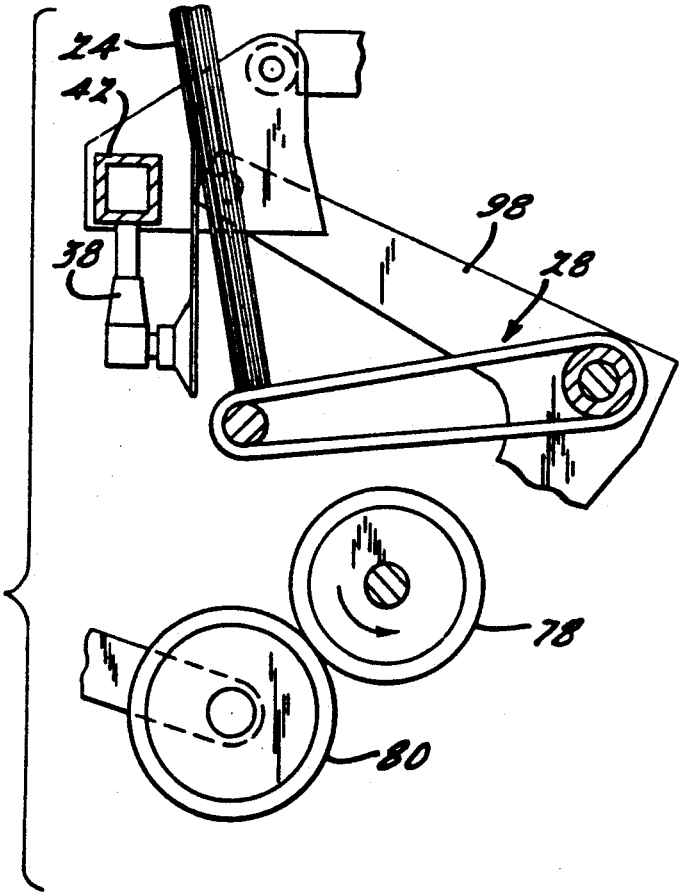

FIGS. 10 and 11 show the movement of the sucker member towards the stack of sheets to be fed. FIG. 12 shows the sucker member retracted by force of spring 168 after the pressure sensor 45 has sensed the predetermined vacuum level has been achieved.

When start command switch 158 is activated a time delay device 160 is energized concurrently with the energizing of relay 156. Time delay 160 provides a predetermined delay before issuing an electrical command to energize the solenoid activated clutch release retractor 134. When this occurs clutch 124 is allowed to engage axle 82 causing cam 106 to begin rotation. As the cam rotates the movable carriage 36 commences the downwardly articulated movement shown in FIGS. 13 and 14. As seen in FIGS. 13 and 14, a single sheet is pulled downwardly towards engagement with the rollers. When the sheet is positioned properly it is grabbed by the rollers and vacuum is released. FIG. 14 shows the sheet now engaged between the rollers and the sucker member released.

Release of the sucker member is caused when vacuum release switch 150 is activated by arm 108 (FIG. 5). Activation of the vacuum release switch causes the vacuum control valve 62 to vent through orifice 54 to atmosphere. This instantaneously relieves the vacuum within the sucker bar and sucker members, causing the sheet to be released.

Meanwhile, the transfer roller 78 continues to be driven by motor 92. When the cam mechanism rotates to the point at which the latch and hook engage one another, the clutch releases allowing the cam 106 to come to a halt. The transfer roller continues to rotate causing the sheet to be drawn between the rollers, downwardly and out through the sheet feeding apparatus. The time delay mechanism 160 provides a delay adequate to permit the sheet to be pulled away from the stack before the downward articulated movement is commenced. In the presently preferred embodiment a delay of less than 1 second is adequate for this purpose. The restricted orifice 119 is selected to provide relatively slow forward movement of the sucker members toward the sheet to be fed. It is important that movement of the sucker member be slow so that the sucker member will not overshoot and drive too far into the stack of sheets to be fed. Retraction of the sucker member by spring 168 is relatively fast, in comparison.

The stock advance mechanism operates until the sheet edge sensor 72 triggers microswitch 74. This is illustrated in FIG. 15 by the mechanical connection between the stock of sheets to be fed 164 and the sensor 72. As previously described, the cross shaft 100 drives the ratchet and pawl assembly 68. The ratchet and pawl assembly, in turn, advances the roller 32 which drives the rings or belts 31. Microswitch 74 electrically controls the release solenoid 70, causing the stock advance mechanism to turn off when the sensor 72 is activated.

The Multiple Feed Station Arrangement

Figure 16:
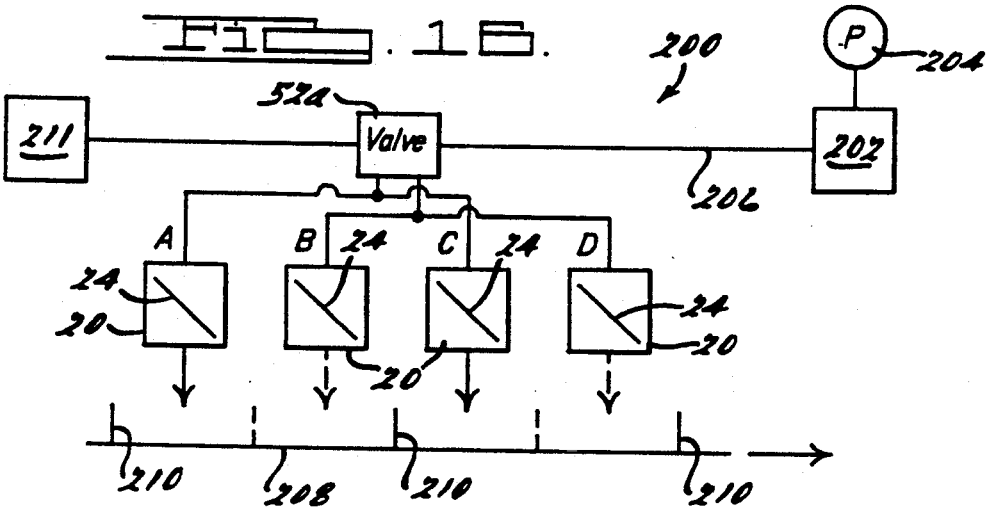
FIG. 16 is a block diagram illustrating the alternating sequence of a multiple feed station.

One of the advantages of the bin 22 with its inclined sidewall arrangement is that multiple feed stations can be packed closely together. This is illustrated diagrammatically in FIG. 16. In FIG. 16 a plurality of feed stations 20 are shown diagrammatically, each having an inclined sidewall 24 shown diagrammatically. The feed stations are fed by a common vacuum system indicated generally at 200. The vacuum system includes a vacuum reservoir 202 which is supplied by vacuum pump 204. Preferably the reservoir is coupled to a manifold 206. The manifold 206 in turn supplies vacuum to a three position, four-way vacuum control valve **52*a* which replaces the individual vacuum control valves 52** of the individual feed stations.

The feed stations are positioned side-by-side in close proximity as depicted diagrammatically. The sheets being fed are ejected onto a moving conveyor 208 which has fingers 210 separating one assembled document from the next. In FIG. 16 the feed stations have been designated by the letters A, B, C and D. Because the feed stations are compact enough to occupy a side-to-side space less than the distance between adjacent fingers 210, the invention can implement a sequenced mode of operation not possible with conventional equipment. Specifically, in the illustrated embodiment, a sequence feed control means 211 causes feed stations A and C feed simultaneously between adjacent fingers 210. Thereafter, as conveyor 208 moves to the position shown by the dashed lines stations B and D feed. This arrangement places considerably less demand on the vacuum system 200, since only half of the feed stations are active at any given time. Also, advantageously, the manifold 206 does not require a leak or vent to atmosphere. Vacuum level fluctuations are smoothed out and stabilized by the reservoir 202.

Although the illustrated embodiment of FIG. 16 employs an even cycle (A, C) odd cycle (B, D) sequence, the sequencing aspects of the aspects of the invention can be implemented using different combinations as well. For example, three feed stations could be packed within the space defined between two adjacent fingers 210 of conveyor 208. In this case a three-step sequence could be utilized, and so forth.

The Misfeed Detection System

Referring to FIGS. 5 and 8, pinch roller 80 is articulated about axle 84 to allow it to separate from the transfer roller 78 when a sheet is fed through. Thus the separation or caliper spacing between pinch roller 80 and transfer roller 78 measure the sheet thickness. This measurement is transferred through collar 220 to the thickness sensing mechanism 222 (FIG. 5). The thickness sensing mechanism includes an optical coupling pair 224, which has a light source and a light sensor in spaced apart relation to one another. The optical coupling pair establishes a light beam across the gap between the light source and light sensor. A flag 226 moves in the directions of the arrows designated A in FIG. 5 as collar 220 rotates. This flag will move from a position in which light source and light sensor are in full optical communication, to a position in which optical communication is fully occluded or blocked. Intermediate positions where light coupling between source and sensor are partially blocked or partially occluded are also possible. Thus the quantity or intensity of the light reaching the light sensor is a measure of the degree of separation between the pinch roller 80 and the transfer roller 78.

Figure 17:
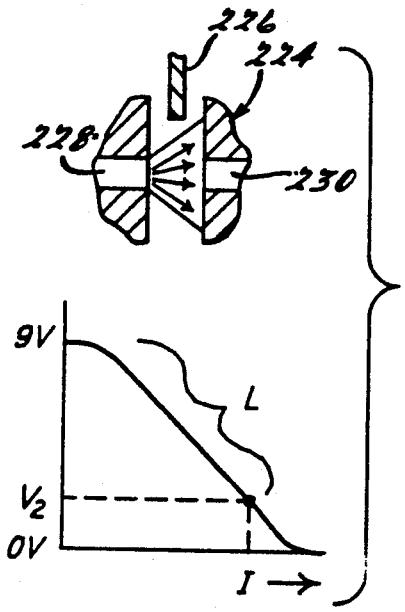
FIGS. 17 and 18 depict the misfeed detection system.
Figure 18:
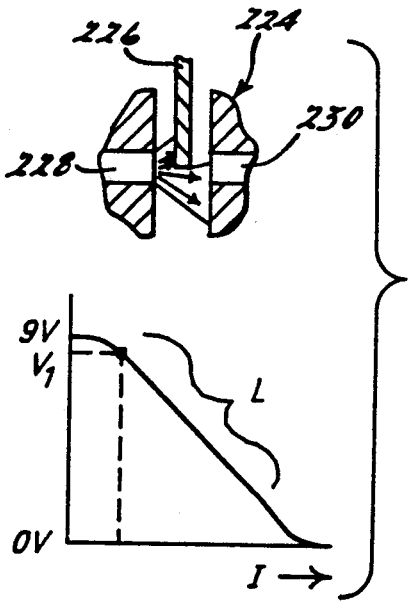

The optical coupling pair is shown in FIGS. 17 and 18, which compare the case (FIG. 17) in which flag 226 does not occlude the light beam to the case (FIG. 18) in which flag 226 partially occludes the light beam.

More specifically, in FIGS. 17 and 18 the light source is shown at 228 and the light sensor at 230. The position of flag 226 is shown in both Figures. As seen, the flag 226 partially blocks the light emanating from light source 228 in FIG. 18. As depicted in the associated curves which plot the voltage output of sensor 230 as a function of light beam intensity, a lower voltage output V, is achieved when the flag does not occlude the light beam. A higher voltage V is produced when the flag partially occludes the light beam as shown in FIG. 18. With the flag fully occluding the light beam, the voltage output of sensor 230 will be at or near its maximum voltage, nominally 9 volts.

The presently preferred electronic circuit for operating the misfeed sheet detection system is shown in FIG. 19. Beginning at the left of FIG. 19, light source 228 and light sensor 230 are shown along with flag 226. The output of light sensor 230 is fed to a voltage controlled oscillator 232 which in turn receives a NOT enable signal on line 234 through an inverter. This signal is derived from the enable "one-shot," and is used to enable counter 236 to begin counting for a predetermined time interval, during which time the frequency of voltage controlled oscillator 232 is measured and stored in counter 236. The presently preferred circuit also uses a second counter 238 to store a value used as the "proof" against which the value in counter 236 is compared. The circuitry includes a run/proof switch 240 which places the circuitry in the proof mode. In the proof mode counter 238 is used to measure the frequency of voltage controlled oscillator 232. By allowing a sheet of acceptable thickness to be fed during the proof mode, counter 238 is thus loaded with the frequency count indicative of a normal sheet feed condition.

With switch 240 in the run mode, the contents of counter 236 are compared with the stored proof value in counter 238 by a comparator 242. Depending on the results of the comparison, if the count in the run counter 236 is greater than the count in proof counter 238, a misfeed condition is detected and latched by flip-flop 244, thereby lighting the misfeed light 246. On the other hand, if the count in run counter 236 is less than the count in proof counter 238 a double feed error condition is detected and latched by flip-flop 248, thereby lighting the double feed light 250. If the count in run counter 236 equals the count in proof counter 238 no error detection is declared.

The outputs of both flip-flops 244 and 248 are fed to OR gate 252 so that either a misfeed or a double feed condition will trigger solid-state relay 254 to stop the machine and also trigger solid-state relay 256 to light the error light 258.

Figure 20:
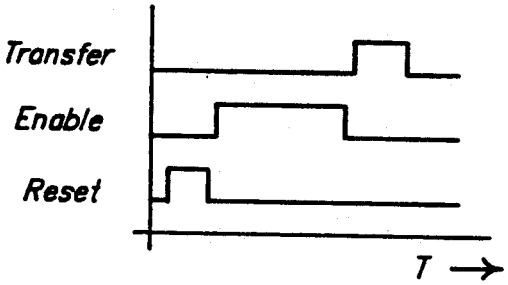
FIG. 20 is a timing diagram for the misfeed detection system.
Figure 10:
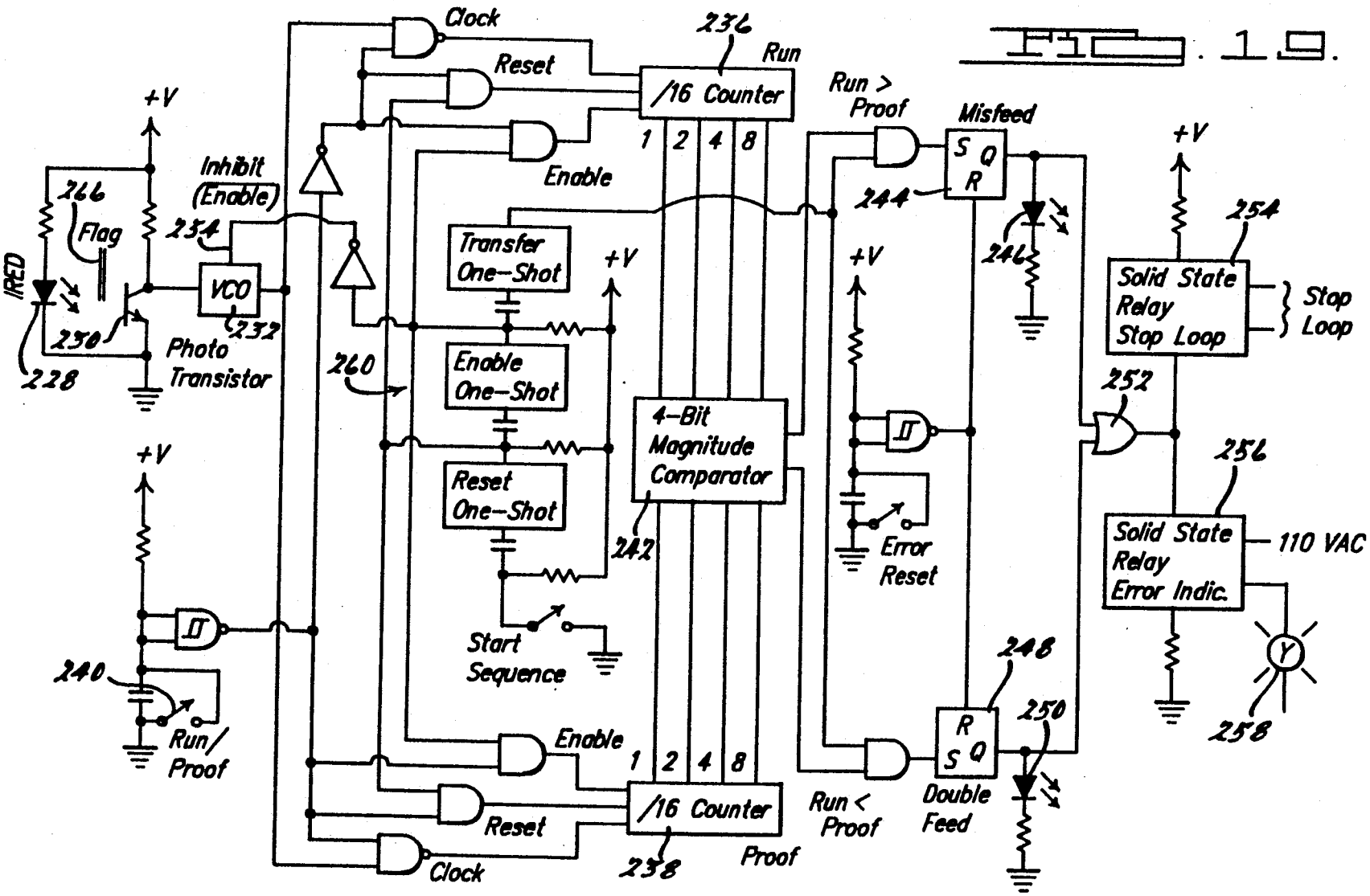

The timing logic which controls the operation of VCO 232, counter 236 in the run mode and counter 238 in the proof mode is depicted generally at 260. This logic includes a one shot multivibrator for effecting each of the transfer, enable and reset functions as illustrated. FIG. 20 gives a timing diagram showing the signals produced by these one shot multivibrators.

In the preferred embodiment the enable output pulse is set to produce a maximum count (e.g., 15 on a 0–15 scale) with no paper in the calipers. The enable output pulse is set to a minimum count (e.g., 1 on a 0–15 scale) with maximum thickness paper in the calipers. With such a setting, a double-feed (error condition) would give a reading of 0 on the 0–15 scale. Although a 4 bit system has been illustrated, a greater number of bits can also be used to increase resolution if desired. Also, the system can be constructed with a small dead band to allow comparator 242 to accept slight thickness differences as being within acceptable tolerances. This could be done, for example, by ignoring the least significant bit, or by using multiple counters coupled with appropriate logic gates.

As seen in FIGS. 17 and 18, the optical coupling pair operates in the linear region depicted by reference letter L (e.g., 3.5 to 8.5 volts). As such, the optical coupling pair provides an analog sheet thickness measurement. One advantage of the analog measurement system is that subtle differences in sheet thickness are detectable. Although the presently preferred embodiment uses a voltage to frequency conversion technique to compare the run thickness with the proof thickness, analog comparator circuits could also be used. Moreover, while the voltage to frequency conversion technique is presently preferred, other analog to digital conversion hardware and software may be used for a given application. It should also be appreciated from FIGS. 17 and 18 that there is an inverse relationship between the voltage produced by the sensor 230 and the frequency output of the oscillator 232. This relationship is advantageous because the oscillator frequency will be high when the sheet thickness is relatively thin. Accordingly, a finer gradient of sheet thickness may be more readily detected.

From the foregoing, it will be understood that the sheet feeding apparatus of the invention provides a number of distinct advantages over conventional sheet feeding systems. An electrical vacuum sensing control system provides precise detection of the point at which sufficient vacuum is achieved to lift a sheet, without producing excessive vacuum which might cause a misfeed. The sheets are held on a steeply inclined stack, which reduces the gravity load on the stack of sheets, making the sheets feed more easily with less likelihood of sticking together. Also, the inclined stack arrangement makes the individual feed station quite compact. This allows a multiple document feed station system to be assembled in very little space. Furthermore, by this tightly compact arrangement the invention is able to effect a sequenced feed control scheme which reduces peak loading on the vacuum supply systems thereby reducing cost. Also, the invention has a highly accurate misfeed detection system which uses sensitive analog optical and digital circuitry to detect sheet feeding errors.

While the invention has been described in connection with the presently preferred embodiment, it will be understood that certain modifications or changes can be made to the apparatus described herein without departing from the spirit of the invention as set forth in the appended claims.

What is claimed is:

1. A sheet feeding apparatus comprising:

a bin for containing a stack of sheets to be fed;

a movable carriage supporting at least one sucker member;

a suction means for apply a vacuum to said sucker member;

movement means for selectively moving said carriage in an engaging direction, by which said sucker member is brought into contact with a sheet on said stack of sheets to be fed, and in a retracting direction, by which said sucker member moves away from said stack of sheets to be fed;

a control means coupled to said movement means for providing an electrical signal for selecting the direction of movement of said movement means;

said control means including vacuum sensing transducer means communicating with said sucker member, said control means using said transducer means to detect when contact is made between said sucker member and said stack of sheets;

said control means providing an electrical signal to initiate movement of said carriage in said engaging direction through a continuous motion and to initiate movement of said carriage in said retracting direction the instant contact is made and vacuum pressure at said sucker member attains a predetermined level adequate to hold a single sheet in contact with said sucker member during movement in the retracting direction.

2. The apparatus of claim 1 wherein said movement means comprises fluid pressure drive means for moving said carriage in said engaging direction.

3. The apparatus of claim 1 wherein said movement means comprises air pressure drive means for moving said carriage in said engaging direction.

4. The apparatus of claim 1 wherein said movement means comprises fluid pressure drive means having restricted orifice means for moving said carriage in said engaging direction at a controlled rate.

5. The apparatus of claim 1 wherein said movement means comprises spring means for moving said carriage in said retracting direction.

6. The apparatus of claim 1 wherein said transducer means is an electrical vacuum switching means.

7. The apparatus of claim 1 wherein said movement means further comprises means for effecting articulated movement of said sucker member.

8. The apparatus of claim 1 further comprising roller means for transporting a sheet to be fed and wherein said movement means further comprises means for effecting articulated movement of said sucker member to a position at which a sheet in contact with said sucker member is grabbed by said roller means.

9. The apparatus of claim 1 further comprising stock advance means coupled to said bin for moving said stack of sheets generally toward said sucker member.

* * * * *